United States Patent [19]

Gilman

[11] 4,256,039

[45] Mar. 17, 1981

[54] ARMOR-PIERCING PROJECTILE

[75] Inventor: John J. Gilman, Convent Station, N.J.

[73] Assignee: Allied Chemical Corporation, Morris Township, Morris County, N.J.

[21] Appl. No.: 627

[22] Filed: Jan. 2, 1979

[51] Int. Cl.[3] ..... F42B 11/14; F42B 13/04; F42B 15/26

[52] U.S. Cl. ..... 102/52; 102/92.3; 102/92.4

[58] Field of Search ..... 102/38 R, 52, 92.1-92.4

[56] References Cited

U.S. PATENT DOCUMENTS

| | | | |
|---|---|---|---|
| 355,653 | 1/1887 | Loyd | 102/92.4 |
| 3,856,074 | 12/1974 | Kavesh | 164/87 |
| 3,856,513 | 12/1974 | Chen et al. | 75/122 |
| 3,981,722 | 9/1976 | Ray et al. | 75/122.7 |
| 4,036,638 | 7/1977 | Ray et al. | 75/123 B |
| 4,044,679 | 8/1977 | Pagano et al. | 102/52 |
| 4,059,441 | 11/1977 | Ray et al. | 75/177 |

OTHER PUBLICATIONS

*Metallic Glasses A New Technology*, J. J. Gilman, 1976, Crystal Growth and Materials edited by E. Kaldig and H. J. Schod, 1977.

Mechanical Behavior of Metallic Glass, J. J. Gilman, J of Applied Physics, vol. 46, No. 4, Apr. 1975, pp. 1625-1633.

*Primary Examiner*—Harold J. Tudor

*Attorney, Agent, or Firm*—Ernest D. Buff; Gerhard H. Fuchs

[57] ABSTRACT

An armor-piercing projectile is provided having hardened multi-layers and being relatively simple in design. The projectile includes an axial bore, a continuous strip of metallic glass wound about the core to form for the projectile a laminated body, a generally conical frontal surface, and a transverse rear surface, and a bonding agent for joining the adjacent laminated surfaces.

11 Claims, 4 Drawing Figures

ARMOR-PIERCING PROJECTILE

BACKGROUND OF THE INVENTION

The present invention relates generally to armor-piercing projectiles and specifically to armor-piercing projectiles having a luminated or layered construction.

The primary function of an armor-piercing projectile is to penetrate the armor surrounding otherwise vulnerable targets, such as intricate machines or personnel. The effectiveness of the projectile depends fundamentally on its kinetic energy, i.e., the higher the mass or velocity, the greater the terminal effects on the target.

The projectile may be defeated upon impacting the hardened target by shock-induced brittle fracture for high hardness projectiles, termed "breakup", or by excessive plastic flow for tough, ductile projectiles, termed "mushrooming". A high penetrating capability using a monolithic projectile typically is difficult to achieve, since generally high hardness and high toughness are to some extent mutually exclusive metallurgical properties. As is known, a compound projectile, consisting of a tough core surrounded by a hardened shell, tends to strike a balance between the properties of hardness needed to penetrate and toughness needed to maintain structural integrity.

This concept has been extended to utilize multilaminations of a selected hardness and toughness gradient such that hardness decreases and toughness increases from the outer layer to the inner core. Thus, a number of layers must be broken up before the structural integrity of the core is jeopardized. Further, the interfaces between the layers apparently serve to interrupt brittle crack propagation and to act as acoustical scattering surfaces tending to diminish resonant excitation. This approach is shown in U.S. Pat. No. 4,044,679 "Laminated Armor-Piercing Projectile", issued Aug. 30, 1977, to V. Pagano and S. Tasdemiroglu. However, the improved penetrating capability of the multilayered design is apparently attained at the expense of increased complexity of manufacture.

SUMMARY OF THE INVENTION

The present invention provides for a multi-layered armor-piercing projectile which may be constructed with relative simplicity. The armor-piercing projectile of the invention includes (a) an axial core, (b) a continuous strip of metallic glass wound about the core, forming for the projectile a laminated body, a generally conical frontal surface, and a transverse rear surface, and (c) bonding means for joining the adjacent laminated surfaces within the projectile. The strip preferably has an aspect ratio (width/thickness) substantially greater than the length-to-diameter ratio of the projectile, and a length substantially greater than the length of the projectile.

The particular metallic glass is preferably one having a hardness and yield strength at least comparable to that of conventional high strength steels. Bonding may be accomplished by adhesive joining and also by furnace soldering or brazing if carried out at a temperature lower than the devitrification temperature of the particular metallic glass.

Essentially, the projectile is built up by winding a continuous metallic strip of selected hardness properties about either a penetrator core or a ballast core with suitable bonding means applied between the turns of the winding to secure the configuration. Alternatively, the strip may be wound about a mandrel and the core subsequently inserted after withdrawal of the mandrel. However, it is not critical that the core be a solid core in the case where the core diameter is small relative to the diameter of the projectile.

Metallic glasses are especially suited for the strip material as they are readily produced in continuous strip form. Further, certain of these metallic glasses possess extraordinary hardness and biaxial yield strength, approaching the ultimate strength of the material.

The term "metallic glass" as used herein is intended to refer to metals and alloys that are rapidly quenched from the liquid state to a substantially amorphous (non-crystalline) solid state, typically having less than about 50% crystallinity, and is considered to be synonymous with such terms as "glassy metal alloy" and "amorphous metal alloy". Metallic glasses are well documented in the literature. For an extensive background, see American Society for Metals, "Metallic Glasses" (1978).

BRIEF DESCRIPTION OF THE DRAWINGS

Further details are given below with reference to the examples shown in the drawings wherein.

DESCRIPTION OF THE PREFERRED EMBODIMENTS

Figure 1:
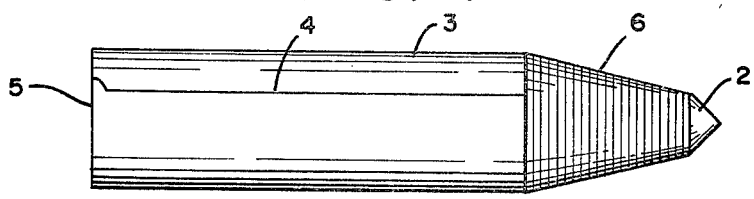
FIG. 1 is a side elevation view of an armor-piercing projectile of the present invention, with the scrolled construction being especially apparent at the generally conical frontal surface.
Figure 2:
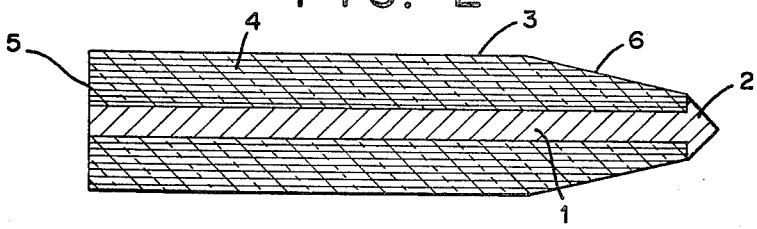
FIG. 2 is a cross-sectional view taken along the longitudinal axis of the projectile shown in FIG. 1, showing the penetrator core within the scrolling.
Figure 3:
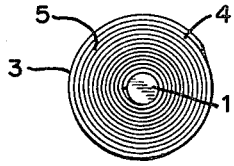
FIG. 3 is a rear elevation view of the projectile emphasizing the scrolled construction.
Figure 4:
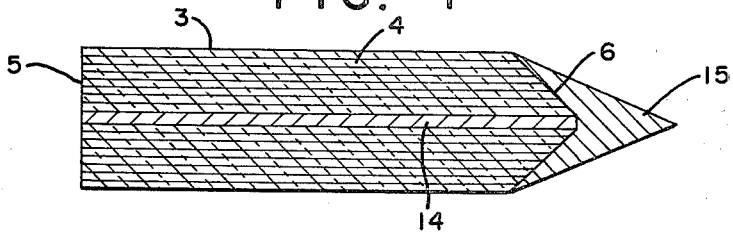
FIG. 4 is a longitudinal cross-section of an alternative embodiment having a dissimilar frontal piece and a nonload-bearing ballast core.

Referring more particularly to the drawings, a side elevation view of the projectile of the present invention and its longitudinal cross-section are shown in FIGS. 1 and 2 respectively. A continuous strip 4 of a metallic glass is tightly wound about a penetrator core 1 having a percussion head 2. The projectile has a monospirally wound body 3, a transverse rear surface 5, and a shaped conical frontal surface 6. In FIG. 3, a rear elevation view is shown of the projectile emphasizing the scrolled configuration of the strip 4 about the core 1. Adjacent surfaces within the projectile are bonded to secure the configuration. In FIG. 4, the longitudinal cross-section of an alternative embodiment is shown having a separate frontal piece 15 secured over the frontal surface 6 of the wound body 3 surrounding a nonload-bearing ballast core 14.

Metallic glasses are especially suited for use in the armor-piercing projectile since they are readily produced in thin strip form, and many have extraordinary hardness and strength properties. A continuous filament of metallic glass may be continuously cast by extruding molten alloy through a nozzle onto a rotating quench surface, as is representatively shown in U.S. Pat. No. 3,856,074 "Method of Centrifugal Production of Continuous Metal Filaments", issued Dec. 24, 1974 to S. Kavesh. Such filaments are necessarily thin, typically about 50 to 200 microns, due to heat transfer requirements, since extremely high quench rates, typically $10^{6}$° C. per second, are required to prevent crystallization in cooling the alloy from its melting temperature below its glass transition temperature. A wide range of metallic glasses are described in U.S. Pat. No. 3,856,513 "Novel Amorphous Metals and Amorphous Metal Articles", issued Dec. 24, 1974, to H. Chen and D. Polk.

Metallic glasses typically have a yield strength at least comparable to high-strength steels; and, in many cases, the yield strength approaches the ultimate strength while maintaining a comparable toughness or capacity to absorb impact energy and comparable stiffness or capacity to resist buckling under longitudinal compressive loading. Further, the strength properties of metallic glasses are nearly isotropic or nondirectional owing to the absence of long-range crystalline structure. Thus, these desirable properties are obtained biaxially. These characteristics are further discussed in "Metallic Glasses—A New Technology", North Holland Publishing Company (1977) and "Mechanical Behavior of Metallic Glasses", 46:4 Journal of Applied Physics 1625 (1975), both by J. Gilman.

Metallic glasses having a high hardness in the range of about 800 to about 1400 kg/mm$^2$, and therefore being especially suited for the present invention, are shown in U.S. Pat. Nos., which are hereby incorporated by reference, 4,036,638 "Binary Amorphous Alloys of Iron or Cobalt and Boron", issued July 19, 1977, to R. Ray and S. Kavesh, and 4,059,441 "Metallic Glasses with High Crystallization Temperatures and High Hardness Values", issued Nov. 22, 1977, to R. Ray et al. Alternatively, where high density is the prime consideration, heavy metallic glasses are available, as representatively shown in U.S. Pat. No. 3,981,722 "Amorphous Alloys in the U-CR-V System", issued Sept. 21, 1976, to R. Ray and E. Musso.

The projectile of the present invention may be compared favorably to classes of projectiles other than those of a layered construction. For example, reference is made to a class of armor-piercing projectiles utilizing a filamentary reinforced construction wherein fibers having high longitudinal strength are embedded axially within a matrix material to form the body of the projectile. The low transverse strength of these fibers provides little improvement in the resistance to transverse fracture of the projectile, in sharp contrast to the biaxially strong strip utilized in the present invention. Further, fibers (cylinders) may only be packed up to a maximum packing fraction of about 91%, whereas the wound strip of the present invention allows nearly a 100% packing fraction thereby tending to increase the resistance to buckling of an otherwise comparable projectile.

In making the embodiment of the present invention as shown in FIG. 1, the continuous strip 4 of metallic glass is monospirally wound about a penetrator core 1 having a percussion head 2. The core is preferably solid and may conventionally be tungsten carbide. The frontal surface 6 may be shaped, according to conventional standards of ballistics, by machining or, alternatively, by cutting before winding the frontal edge of the strip 4 in a pattern that will produce the desired frontal shape upon winding, whether conical, ogive, or otherwise.

To illustrate generally, reference is made to a spin-stabilized 20 mm projectile having a length-to-diameter ratio of 5 calibers. The strip width is selected as about equal to the projectile length or 100 mm. Thus, for a strip of 50 microns thickness and a core diameter of 5 mm, about 150 turns would be taken in scrolling a strip about 5.9 meters in length. It is noted that the aspect ratio of the strip (width/thickness) will typically be substantially greater than the length-to-diameter ratio of the projectile. In the above example, the aspect ratio of the strip is 2000. Alternatively, a strip having a width less than the length of the projectile may be utilized if winding is carried out transversely about the core (helically).

Bonding means for joining the adjacent laminated surfaces within the projectile may be provided by at least several methods. Organic adhesives may be utilized by interjection between the turns of the strip during winding. Standard preparatory surface treatment of cleaning and etching may be done to take full advantage of the bonding properties of the adhesive. Commercially available epoxy adhesives, such as nylon-epoxy and epoxy-polyamide adhesives, are representative of satisfactory adhesives, providing a metal-to-metal bonding shear strength in the range of about 150 to 400 kg/cm$^2$. It may readily be shown that a substantially mechanically monolithic laminated body is obtained, for thin laminations, if the join strength between the layers is at least about equal to the strength of the material being joined divided by its aspect ratio. Applying the above referenced class of iron-boron metallic glasses, having a yield strength up to about 42,000 kg/cm$^2$, to the foregoing example of a strip aspect ratio of 2000, it is apparent that conventional adhesives are more than adequate strengthwise.

Alternatively, conventional furnace soldering or brazing may be utilized, whereby the joining material is drawn into the interstices between the turns by capillary action, provided that the melting temperature of the joining material is lower than the devitrification temperature for the particular metallic glass, typically 400° to 500° C. If the metallic glass were crystallized (and no longer glassy), then its extraordinary strength properties would be diminished. Further, it may be desirable to use a high density joining material to increase the bulk density of the projectile.

The alternative embodiment shown in FIG. 4 utilizes a ballast core 14 which is substantially nonloadbearing, as opposed to a penetrator core, which serves to increase the bulk density of the projectile. First, the strip 4 is wound on a mandrel. The winding is removed leaving an axial core void which is filled with a ultra high density material, suitably depleted uranium. The diameter of the axial core may range from a lower limit, corresponding to the minimum radius of curvature required to initiate winding of the strip, up to a size leaving a sufficient number of strip turns for adequate structural sheathing of the projectile. A dissimilar frontal piece 15 may be attached for aerodynamic or impact considerations, as is conventional. It is noted that the presence of a core filler or solid core is not essential, especially in the case where the core diameter is quite small relative to the diameter of the projectile.

While preferred embodiments of the invention have been illustrated and described, it will be recognized that the invention may be otherwise variously embodied and practiced within the scope of the following claims:

I claim:

1. An armor-piercing projectile comprising:

(a) an axial core;

(b) a continuous strip of metallic glass wound about said core, forming for the projectile a laminated body, a generally conical frontal surface, and a transverse rear surface; and (c) bonding means for joining the adjacent laminated surfaces.

2. A projectile as in claim 1 wherein said core is a penetrator core having a percussion head.

3. A projectile as in claim 1 wherein said core is a ballast core of high density.

4. A projectile as in claim 1 wherein said strip has an aspect ratio substantially greater than the length-to-diameter ratio of the projectile and a length substantially greater than the length of the projectile.

5. A projectile as in claim 1 wherein said metallic glass has a hardness of at least about 800 kg/mm$^2$.

6. A projectile as in claim 1 wherein said strip is monospirally wound about said core.

7. A projectile as in claim 1 wherein said strip is transversely wound about said core.

8. A projectile as in claim 1 wherein said adjacent laminated surface are joined adhesively.

9. A projectile as in claim 1 wherein said adjacent laminated surfaces are joined by soldering at a temperature lower than the devitrification temperature of said metallic glass.

10. A projectile as in claim 1 wherein said adjacent laminated surfaces are joined by brazing at a temperature lower than the devitrification temperature of said metallic glass.

11. A projectile as in claim 1 wherein said strip has a thickness ranging from about 50 to 200 micrometers.

* * * * *